US006997404B2

(12) United States Patent
Rao

(10) Patent No.: US 6,997,404 B2
(45) Date of Patent: Feb. 14, 2006

(54) POROUS PLASTIC FUEL FILTER FOR A FUEL INJECTOR

(75) Inventor: Arvind M. Rao, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 235 days.

(21) Appl. No.: 10/171,524

(22) Filed: Jun. 12, 2002

(65) Prior Publication Data

US 2003/0230648 A1 Dec. 18, 2003

(51) Int. Cl.
*B05B 1/30* (2006.01)
*F02M 59/00* (2006.01)
*F02M 47/02* (2006.01)

(52) U.S. Cl. ..... 239/585.1; 239/585.3; 239/585.5; 239/533.2; 239/533.12; 239/88

(58) Field of Classification Search ..... 239/585.1, 239/585.2, 585.3, 585.4, 585.5, 533.2, 533.3, 239/88–96; 251/129.15, 129.21; 210/342, 210/315
See application file for complete search history.

(56) References Cited

U.S. PATENT DOCUMENTS 3,599,796 A * 8/1971 Wilhelm ..... 210/457
3,767,054 A * 10/1973 Farrow et al. ..... 210/232
3,795,288 A * 3/1974 Pall ..... 181/42
5,876,599 A * 3/1999 Sylvester et al. ..... 210/232
6,135,094 A * 10/2000 Okada et al. ..... 123/470
6,328,232 B1 12/2001 Haltiner, Jr. et al.
6,434,822 B1 * 8/2002 Perry et al. ..... 29/888.41
6,440,305 B1 * 8/2002 Donnerdal et al. ..... 210/342

FOREIGN PATENT DOCUMENTS

DE 3103723 A1 * 9/1982

* cited by examiner

*Primary Examiner*—Davis Hwu
(74) *Attorney, Agent, or Firm*—Patrick M. Griffin

(57) ABSTRACT

An improved filter assembly for a solenoid-actuated fuel injector having a fuel-resistant porous filter element in a filter retainer tube for disposition in the fuel tube of the fuel injector. Fuel flow through the filter element is axial. The filter retainer tube replaces the calibration tube in a prior art fuel injector, also acting as a seat for the injector spring and being positioned axially within the fuel tube by a press-fit calibration ring. The retainer tube is preferably formed of glass-filled nylon, and the filter element is preferably formed by injection molding of an open-cell polyamide foam. By selecting the porosity and flow characteristics of the filter element material in known fashion, the length and diameter of the filter element may be minimized, permitting reduction in the length and diameter of the fuel tube and also the size and cost of the actuating solenoid assembly.

9 Claims, 3 Drawing Sheets

POROUS PLASTIC FUEL FILTER FOR A FUEL INJECTOR

TECHNICAL FIELD

The present invention relates to fuel injectors; more particularly, to internal filters for removing particles from fuel ahead of the injector valve; and, most particularly, to a fuel filter formed of a porous medium which provides an axial-flow depth filter, superceding a prior art radial-flow screen filter, and which reduces the volume of space required for filtration, permitting a reduction in size of a fuel injector.

BACKGROUND OF THE INVENTION

Fuel injectors for internal combustion engines or fuel cells are well known. A typical fuel injector comprises a fuel metering valve disposed in a first end portion for insertion into an engine cylinder intake port; an electric solenoid actuator for actuating the valve; and a central fuel tube for receiving fuel from a fuel source such as a fuel rail and conveying the fuel axially through the solenoid to the metering valve. Disposed within the fuel tube is a calibration tube which acts as a seat for a valve-closing coil spring, the compression of which is determined by the axial position of the calibration tube within the fuel tube. In flowing through the fuel tube, fuel also flows through the calibration tube. Disposed within the calibration tube is a plastic filter comprising an integral screen filter medium having a nominal pore size of, typically, about 30 $\mu$m.

Prior art fuel filters are subject to at least two serious operational shortcomings because the filter medium is essentially a surface screen. First, the particulate-retention capacity is undesirably small; that is, the filter may be partially or even fully blocked by relatively little particulate matter, especially by large particles. Second, as the filter begins to plug, the pressure drop across the filter increases, which may force particles through the filter with consequent fouling of the metering valve, causing failure of the fuel injector.

Further, because flow through the filter is essentially radial, an annular fuel flow space must be provided between the filter and the calibration tube, which increases the diameter of the fuel injector and thus increases the size and cost of the solenoid.

It is a principal object of the present invention to provide higher capacity fuel filtration for a fuel injector.

It is a further object of the present invention to increase the reliability of a fuel injector.

It is a still further object of the invention to reduce overall dimensions of a fuel injector.

SUMMARY OF THE INVENTION

Briefly described, an improved filter assembly for a solenoid-actuated fuel injector in accordance with the invention comprises a fuel-resistant porous filter element in a filter retainer tube for disposition in the fuel tube of the fuel injector. Fuel flow through the filter element is axial. The filter retainer tube replaces the calibration tube in a prior art fuel injector, also acting as a seat for the injector spring and being positioned axially within the fuel tube by a press-fit calibration ring. The retainer tube is preferably formed of glass-filled nylon, and the filter element is preferably formed of open-cell nylon 12 foamed in place by known techniques during molding of the element. By selecting the porosity and flow characteristics of the filter element in known fashion, the length and diameter of the filter element may be minimized, permitting reduction in the length and diameter of the fuel tube and also the size and cost of the actuating solenoid.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

The improvement and benefits provided by the invention may be better appreciated by first considering a prior art fuel injector and fuel filtration means.

Figure 1:
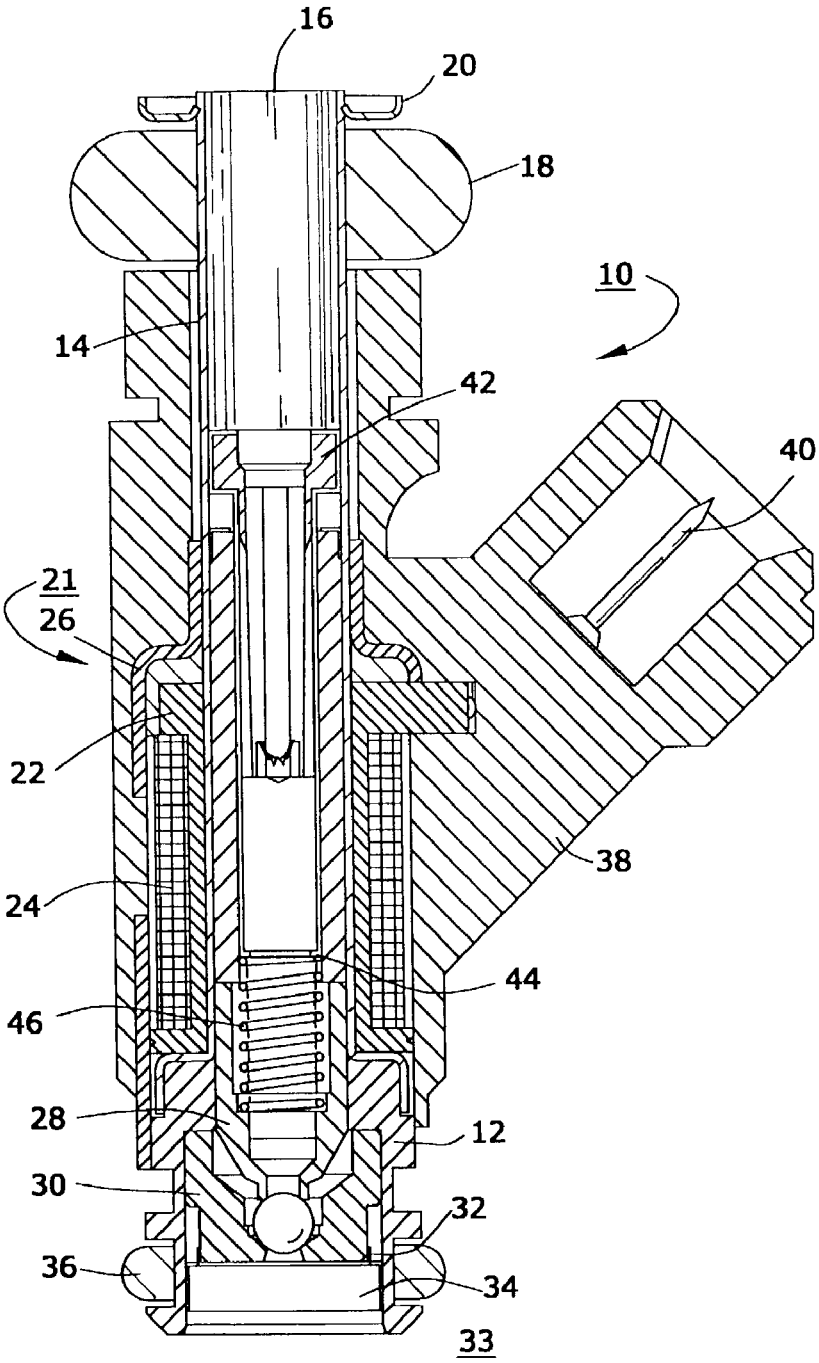
FIG.1 PRIOR ART
FIG. 1 is an elevational cutaway view of a prior art fuel injector, showing a conventional calibration tube and screen fuel filter.
Figure 2:
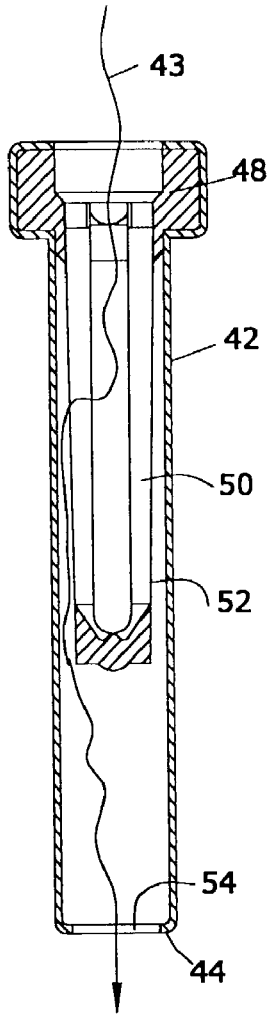
FIG.2 PRIOR ART
FIG. 2 is a cross-sectional view of a prior art calibration tube and fuel filter for use in the fuel injector shown in FIG. 1.

Referring to FIGS. 1 and 2, a prior art fuel injector 10 (such as, for example, a Multec 3 Injector, available from Delphi Automotive, Troy, Mich., USA) includes a solenoid body 12 mated with a fuel tube 14 for receiving fuel at an upper end 16 from a fuel source (not shown) such as a fuel rail, as is known in the art. Injector 10 is typically sealingly secured to the fuel source via an upper seal ring 18 and ring retainer 20. Surrounding fuel tube 14 is solenoid assembly 21 including a bobbin 22 supporting electrical coil 24, enclosed by coil body 26. A valve assembly 28 is slidingly disposed within solenoid body 12 and mates with seat assembly 30. A director 32 below the seat assembly assists in atomizing and directing fuel injected through the valve. The director 32 is retained within the fuel injector by a director retainer 34, and the fuel injector is sealed into a port (not shown) in an intake manifold 33 of internal combustion engine 35 by manifold seal ring 36. The solenoid and fuel tube are encapsulated by a molded plastic shroud 38 which also supports an electrical connector 40 for the solenoid assembly 21. The well-known fuel injector arrangement as recited thus far is also common to a fuel injector 10' in accordance with the invention, as shown in FIG. 3.

Referring still to prior art injector 10 as shown in FIGS. 1 and 2, a metal calibration tube 42 is disposed within fuel tube 14 and is retained therein, as by press fit, staking, or spot welding, at a predetermined axial location. Calibration tube 42 is crimped inwards 44 at the nether end to form a seat for valve return spring 46 which acts to close the valve assembly against the seat assembly. The compression of spring 46, and hence the time response of the valve mechanism, is determined by the axial position of calibration tube 42 within fuel tube 14.

Tube 42 further supports an injection-molded plastic filter housing 48 and screen 50. Fuel 43 flowing through fuel tube 14 from inlet end 16 to valve assembly 28 passes through screen 50 in a substantially radial direction from inside to outside, exiting screen 50 in annular space 52 between screen 50 and calibration tube 42. Filtered fuel then flows axially of tube 42 and exits through axial opening 54 in crimped end 44.

Figure 3:
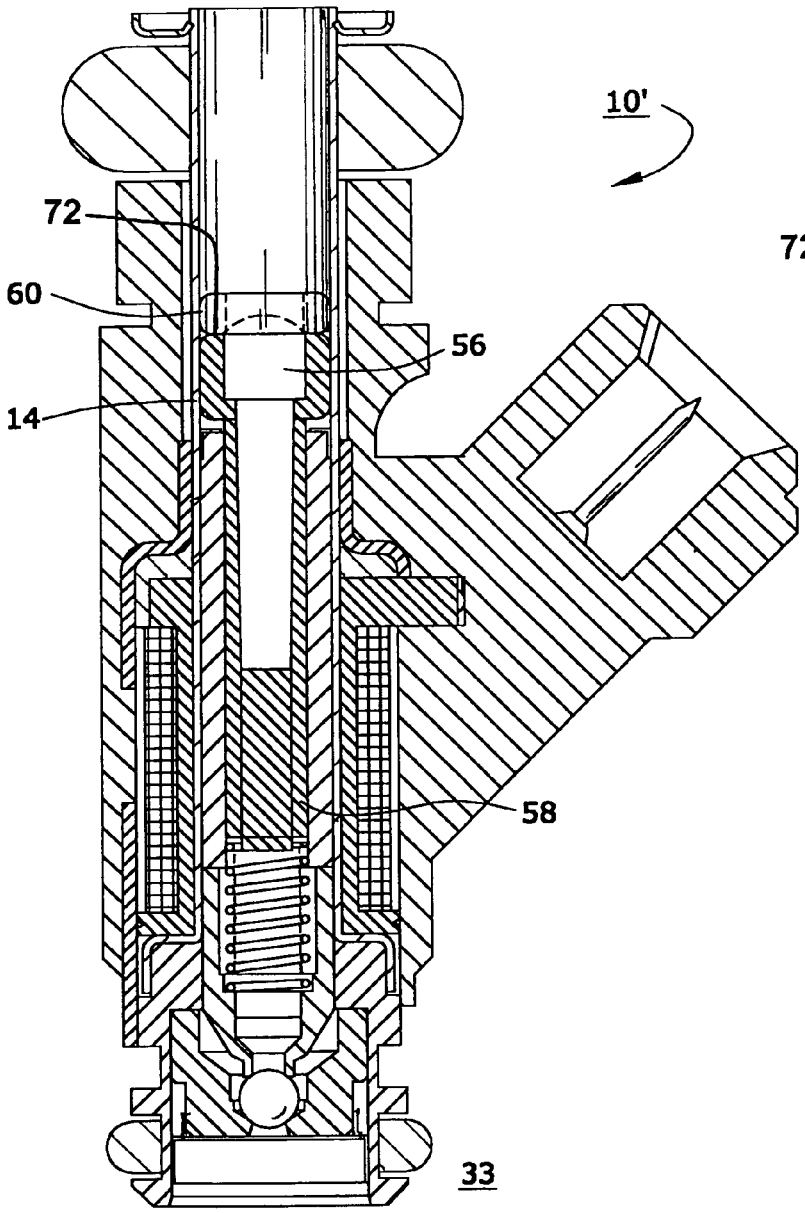
FIG. 3 is an elevational cutaway view of a fuel injector including a filter retaining tube, porous filter element, and calibration ring in accordance with the invention.
Figure 4:
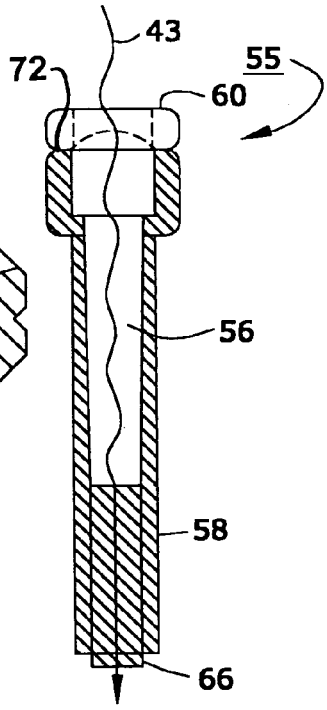
FIG. 4 is an elevational cross-sectional view of a filter assembly for a fuel injector, in accordance with the invention.
Figure 5:
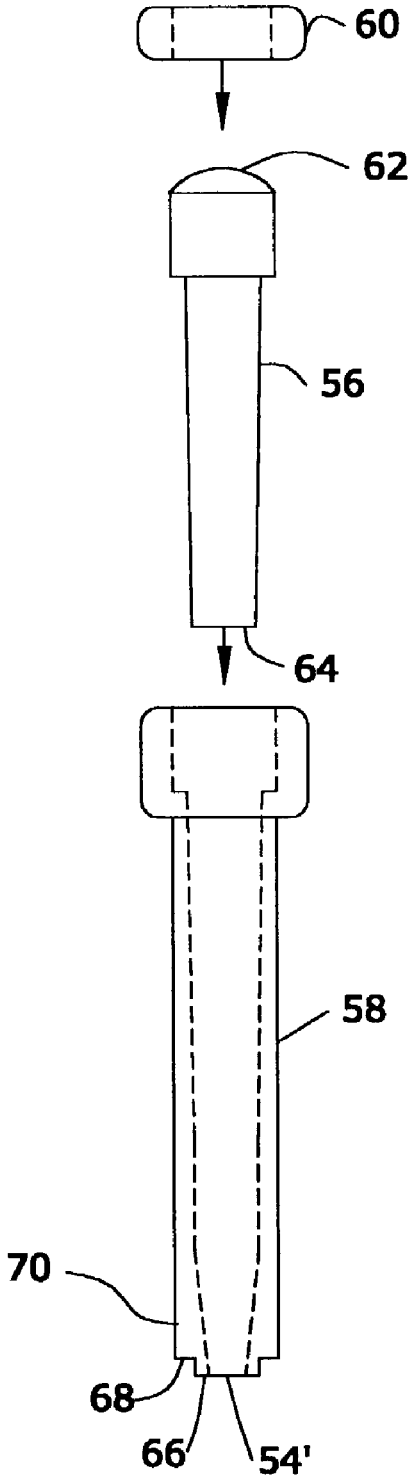
FIG. 5 is an exploded elevational drawing of a filter assembly in accordance with the invention.

Referring to FIGS. 3 through 5, in an improved fuel injector 10' in accordance with the invention, an improved filter assembly 55 comprising filter element 56, filter retainer tube 58, and calibration ring 60 replaces prior art filter 48, 50 and calibration tube 42, respectively. In operation, fuel 43 enters filter element 56 at upper end 62, which preferably is domed as shown in FIG. 5 such that particles too large to enter the filter medium are flushed to the edges of the dome, thereby keeping the central portion unobstructed. Fuel flows axially through element 56, exiting element 56 at lower end 64 and flowing out of retainer tube 58 through axial opening 54'. Because the fuel flows only into end 62 and out of opposite end 64, element 56 may be full-fitting within retainer tube 58 and requires no annular space 52 as in the prior art arrangement.

Filter element 56 is formed of a porous medium having a predetermined porosity and structure. Preferably, element 56 is formed from a thermoplastic compound via a conventional foam-in-place injection molding process to yield an open-cell structure having a convoluted, tortuous fuel flow path. The foam density, porosity, and structure may be controlled by methods well known in the art of plastic forming. Such filtration is known as "depth" filtration, as opposed to "surface" filtration by prior art screen 50. A depth filter in general has a much greater capacity for particle accumulation because it can accumulate particles in three dimensions rather than only two. Additionally, the omnidirectional, but overall axial, tortuous flow path increases the potential for trapping small particles with mean diameters less than that of the nominal pore size because many small traps exist within the open-cell structure of the porous medium. Therefore, a small porous plastic filter, in accordance with the invention, is more effective and capacious than a screen filter of similar efficiency.

Suitable molding compounds, selected for chemical resistance to hydrocarbon and oxygenated fuels, are, for example but not limited to, semicrystalline polyamide-6, polyamide-66, polyamide-11, polyamide-12 such as nylon-12, semi-aromatic amides, syndiodactic polystyrene/polyamide blends, polyacetal, polytetrafluoroethylene and amorphous polyethersulfones, polyetherimides, styrene-acrylonitrile copolymers, and combinations thereof.

Filter element 56 is housed in filter retainer tube 58. The diameter and length of tube 58 may be similar to the dimensions of prior art tube 42, but may also be significantly smaller, being constrained only by the flow characteristics of the filter element. In some applications, significant reductions in the diameters of retainer tube 58 and fuel tube 14 are possible, leading to reduction in the overall size and cost of the fuel injector. Such size and cost reductions are highly desirable.

Filter retainer tube 58 preferably is formed of the same material as is filter element 56, although preferably reinforced with glass fiber for compressive strength. As shown in detail in FIG. 5, tube 58 is provided with an annular boss 66, forming a step 68 with sidewall 70 and forming thereby a seat and centering feature for valve spring 46.

Filter retainer tube 58 is preferably positioned axially and retained at a predetermined location within fuel tube 14 by calibration ring 60 which, like calibration tube 42, is immobilized within tube 14 as by press fit, staking, or spot welding. As best seen in FIGS. 3 and 4 calibration ring 60 is disposed on a distal end 72 of filter retainer tube 58. Ring 60 may be provided as a separate element, as shown in FIGS. 4 and 5, or it may be overmolded integrally as a collar on retainer tube 58 to equal effect.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel injector having a fuel tube and a seat assembly, said fuel injector comprising a fuel filter assembly having a filter retainer tube disposed within said fuel tube, a calibration ring disposed within said fuel tube for retaining and axially positioning said filter retainer tube in said fuel tube, wherein said filter retainer tube is positioned between said seat assembly and said calibration ring; and a depth filter element disposed within said filter retainer tube for axially filtering fuel flowing through said fuel.

2. A fuel injector in accordance with claim 1 wherein said filter element is formed of a thermoplastic material.

3. A fuel injector in accordance with claim 2 wherein said filter retainer tube is formed of the same thermoplastic material as said filter element.

4. A fuel injector in accordance with claim 3 wherein said thermoplastic material forming said filter retainer tube is glass-filled.

5. A fuel injector in accordance with claim 2 wherein said thermoplastic material is an open-cell foam.

6. A fuel injector in accordance with claim 5 wherein said filter element is formed by injection molding.

7. A fuel injector in accordance with claim 2 wherein said thermoplastic material is selected from the group consisting of semicrystalline polyamide-6, polyamide-66, polyamide-11, polyamide-12 such as nylon-12, semi-aromatic amides, syndiodactic polystyrene/polyamide blends, polyacetal, polytetrafluoroethylene and amorphous polyethersulfones, polyetherimides, styrene-acrylonitrile copolymers, and combinations thereof.

8. A fuel injector in accordance with claim 1 wherein said filter element is provided with a domed end.

9. A fuel injector in accordance with claim 1, wherein said calibration ring is in direct contact with said fuel tube.

* * * * *